US008424828B1

(12) United States Patent
Roccasalva et al.

(10) Patent No.: US 8,424,828 B1
(45) Date of Patent: Apr. 23, 2013

(54) WALL GUARD FOR FURNITURE KIT

(76) Inventors: Mike Roccasalva, Richmond Hill (CA); Max Roccasalva, Richmond Hill (CA)

( * ) Notice: Subject to any disclaimer, the term of this patent is extended or adjusted under 35 U.S.C. 154(b) by 46 days.

(21) Appl. No.: 13/194,758

(22) Filed: Jul. 29, 2011

(51) Int. Cl.
*A47B 95/00* (2006.01)

(52) U.S. Cl.
USPC ..... 248/345.1; 248/346.11; 248/188.9

(58) Field of Classification Search ..... 248/188.1, 248/188.2, 188.3, 188.8, 188.9, 346.11, 501, 248/345.1, 615
See application file for complete search history.

(56) References Cited

U.S. PATENT DOCUMENTS

| | | | | | |
|---|---|---|---|---|---|
| 342,970 | A | * | 6/1886 | Ongley | 248/346.11 |
| 1,073,860 | A | * | 9/1913 | Leland | 248/188 |
| 1,158,350 | A | * | 10/1915 | White | 248/345.1 |
| 1,445,726 | A | * | 2/1923 | Soros | 248/345.1 |
| 1,901,377 | A | * | 3/1933 | Forest | 248/345.1 |
| 1,912,728 | A | * | 6/1933 | Forest | 248/346.11 |
| 1,917,601 | A | * | 7/1933 | Schermerhorn | 248/188.9 |
| 1,921,561 | A | * | 8/1933 | Burton | 248/188.9 |
| 1,930,223 | A | * | 10/1933 | Chason | 16/42 T |
| 1,982,138 | A | * | 11/1934 | Herold | 248/346.11 |
| 2,272,884 | A | * | 2/1942 | Zimmerman | 217/53 |
| 2,281,684 | A | * | 5/1942 | Fijux | 248/345.1 |
| 2,683,328 | A | * | 7/1954 | Thulin | 248/345.1 |
| 2,746,203 | A | * | 5/1956 | Gibas | 248/345.1 |
| 3,138,893 | A | * | 6/1964 | Rupar | 248/346.11 |
| 3,191,811 | A | * | 6/1965 | McBroom | 248/345.1 |
| 3,322,389 | A | * | 5/1967 | Janin | 248/345.1 |
| 3,858,838 | A | * | 1/1975 | Woodhouse | 248/345.1 |
| 3,883,923 | A | * | 5/1975 | England | 16/42 R |
| 4,575,034 | A | * | 3/1986 | Tobey | 248/188.9 |
| D336,424 | S | | 6/1993 | Barber | |
| 5,782,444 | A | * | 7/1998 | Anderman et al. | 248/188.8 |
| 5,788,198 | A | * | 8/1998 | Sharpe | 248/210 |
| 5,924,661 | A | * | 7/1999 | Chernack | 248/188.2 |
| 7,163,246 | B2 | * | 1/2007 | Anzaldua | 294/62 |
| 7,284,738 | B1 | * | 10/2007 | Staneart | 248/354.1 |
| 2001/0040206 | A1 | * | 11/2001 | Ferencz | 248/346.11 |
| 2004/0051014 | A1 | * | 3/2004 | Keast et al. | 248/188.9 |
| 2011/0107654 | A1 | * | 5/2011 | Wieler | 43/131 |

* cited by examiner

*Primary Examiner* — Nkeisha Smith

(57) ABSTRACT

A wall guard for furniture kit that underlies furniture legs and includes a pair of rectangular parallelepiped foreleg coasters and a pair of rectangular parallelepiped rear leg coasters, each of the pair of rear leg coasters having a right prism parallelepiped spur horizontally extending therefrom, which spur is slidingly insertable within an attachment member and positional by means of a pin, which attachment member has a gnomon disposed on a rear end to abut a baseboard and maintain a desired distance of a piece of furniture from a wall.

5 Claims, 4 Drawing Sheets

WALL GUARD FOR FURNITURE KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of wall guards for furniture are known in the prior art. However, what is needed is a wall guard for furniture kit that underlies furniture legs and includes a pair of rectangular parallelepiped foreleg coasters and a pair of rectangular parallelepiped rear leg coasters, each of the pair of rear leg coasters having a right prism parallelepiped spur horizontally extending therefrom, which spur is slidingly insertable within an attachment member and positional by means of a pin, which attachment member has a gnomon disposed on a rear end to abut a baseboard and maintain a desired distance of a piece of furniture from a wall.

FIELD OF THE INVENTION

The present invention relates to a wall guard for furniture kit, and more particularly, to a wall guard for furniture kit that underlies furniture legs and includes a pair of rectangular parallelepiped foreleg coasters and a pair of rectangular parallelepiped rear leg coasters, each of the pair of rear leg coasters having a right prism parallelepiped spur horizontally extending therefrom, which spur is slidingly insertable within an attachment member and positional by means of a pin, which attachment member has a gnomon disposed on a rear end to abut a baseboard and maintain a desired distance of a piece of furniture from a wall.

SUMMARY OF THE INVENTION

The general purpose of the wall guard for furniture kit, described subsequently in greater detail, is to provide a wall guard for furniture kit which has many novel features that result in a wall guard for furniture kit which is not anticipated, rendered obvious, suggested, or even implied by prior art, either alone or in combination thereof.

Rearranging furniture in the home or apartment can easily scratch floors, scuff paint, and damage trim work thereby necessitating repair. What is needed is a wall guard for furniture that easily fits under furniture legs to firstly protect the floor finish and secondly keep furniture a safe distance from walls and baseboards.

The present device has been envisioned to underlie furniture legs. The present wall guard for furniture kit includes a pair of rectangular parallelepiped foreleg coasters and a pair of rectangular parallelepiped rear leg coasters. Each of the pair of foreleg coasters has a first top face and a first bottom face. A raised first perimeter surrounds the top face. Each of the pair of foreleg coasters may easily be placed underlying a furniture leg. Each of the pair of foreleg coasters alleviates the pressure exerted by the furniture upon the floor by spreading the weight of the furniture along its first top face. A first cushion layer is disposed continuously upon the first bottom face to engage with the floor when the device is used, thereby lessening scuffing. The first perimeter ensures each of the pair of foreleg coasters remains under the furniture leg, the perimeter enclosing the first top face laterally on four sides. A leg thusly placed on the first top face is less likely to slip off the first top face.

Each of the pair of rear leg coasters has a second top face, a second bottom face, and a rearward edge. A second cushioned layer is disposed continuously upon the second bottom face, for the reasons above described. A raised second perimeter surrounds the second top face, also for the reasons above described.

A right prism parallelepiped spur is centrally disposed upon each of the pair of rear leg coasters. The spur is attached to the second perimeter, and extends perpendicularly therefrom, the spur proximal the rearward edge. A plurality of holes is disposed equidistantly along opposing sides of the spur, the holes oriented in a plane perpendicular with respect to the second top face.

An attachment member slidingly receives the spur, the attachment member having a front end and a rear end. A central cavity is continuously disposed within the attachment member from the front to the rear ends. This cavity is configured to slidingly receive the spur. A pair of holes is disposed on opposing sides of the attachment member proximal the front end, said pair of holes oriented in the same plane as the plurality of holes disposed upon the spur.

A pin is insertable through the pair of holes to engage with the plurality of holes disposed upon the spur when the spur is positioned within the cavity. The pin has a head with a diameter exceeding the diameter of the pair of holes. When inserted through the pair of holes, the pin is securable to the attachment member by means of a Cotter clip inserted through a second pair of holes disposed endwise upon the pin opposite the head.

A parallelepiped gnomon is disposed on the rear end of the attachment member. The gnomon is oriented with a cut-out portion disposed downward to abut a baseboard when the device is used. The gnomon has a foot disposed in the same plane as the second bottom face.

Thusly, the rear leg coaster may be underlain a furniture rear leg, and the spur inserted into the attachment member to a desired distance; the spur fixable within the attachment member by means of the pin engaging with any of the plurality of holes. The rear leg coaster thusly prevents movement of the furniture rearward, towards a wall, the rear leg coaster supporting the furniture and the second perimeter preventing the rear leg from slipping from the second top surface. The spur, secured within the attachment member, maintains distance from the wall, the gnomon abutting the baseboard.

An alternate embodiment of the rear leg coaster is envisioned for use with particular furniture with legs unconformable to the second raised perimeter. A rectangular parallelepiped flat-top coaster, therefore, has a third top face, a third bottom face and a rear edge. A rear wall extends perpendicularly up from the rear edge, and a second spur is centrally disposed on the rear edge extending rearward to engage the attachment member. The second spur is identical with the spur previously described. The flat-top coaster does not have a raised perimeter surrounding the third top surface, and therefore may be used to underlie furniture legs having a greater cross sectional area than may be suited for the rear leg coaster. The rear wall, however, prevents the furniture leg from moving rearwards towards a wall, and thus maintains a desired distance therefrom in like manner as previously described.

Thus has been broadly outlined the more important features of the present wall guard for furniture kit so that the detailed description thereof that follows may be better understood and in order that the present contribution to the art may be better appreciated.

Objects of the present wall guard for furniture kit, along with various novel features that characterize the invention are particularly pointed out in the claims forming a part of this disclosure. For better understanding of the wall guard for furniture kit, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
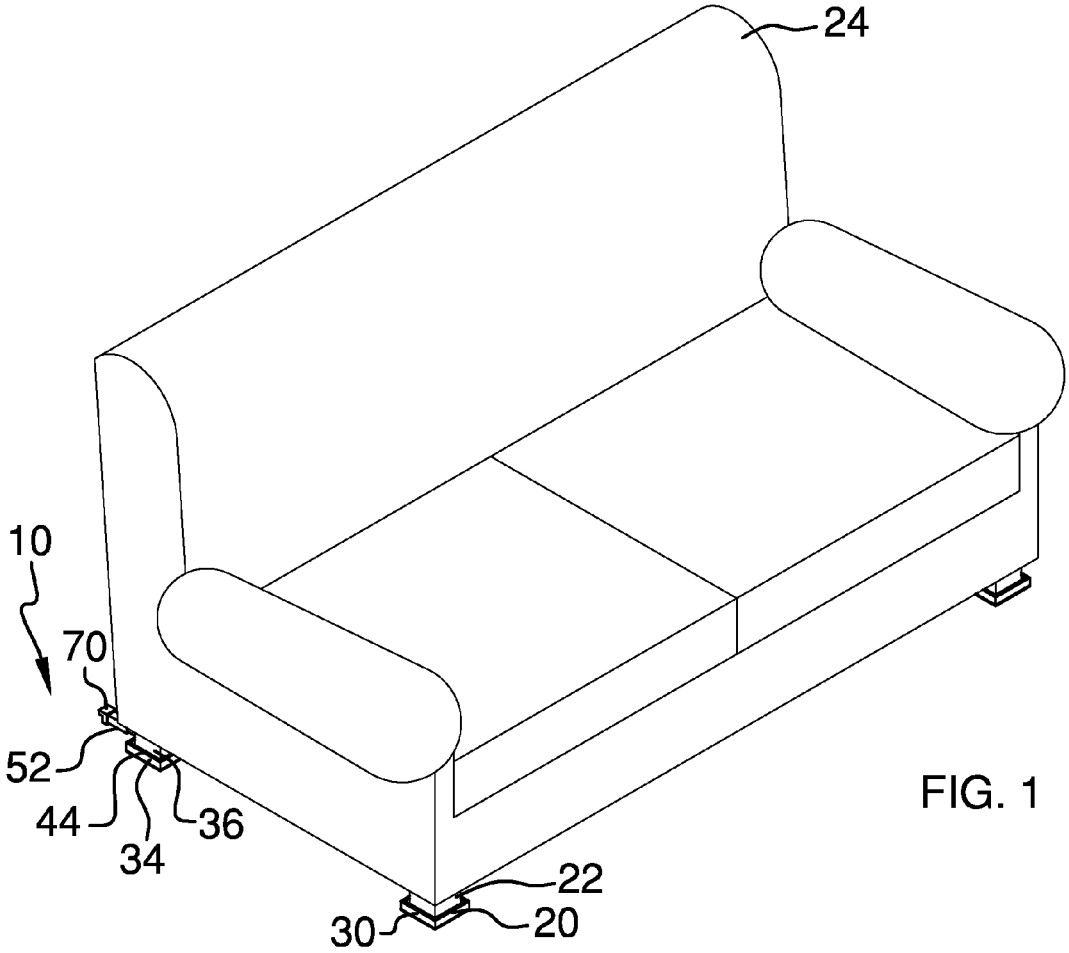
FIG. 1 is an isometric in-use view.
Figure 2:
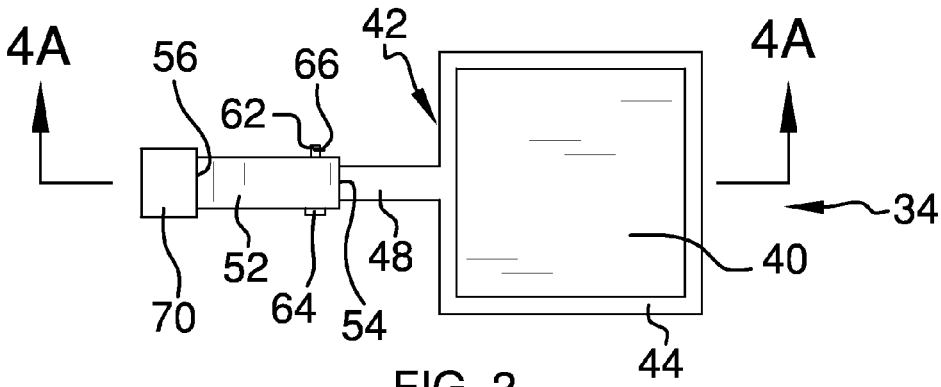
FIG. 2 is a top view.

With reference now to the drawings, and in particular FIGS. 1 through 5 thereof, example of the instant wall guard for furniture kit employing the principles and concepts of the present wall guard for furniture kit and generally designated by the reference number 10 will be described.

Referring to FIGS. 1 through 5 a preferred embodiment of the present wall guard for furniture kit 10 is illustrated.

The wall guard for furniture kit 10 includes each of a pair of rectangular parallelepiped foreleg coasters 20 configured to underlie each of a pair of forelegs 22 of a piece of furniture 24. Each of the pair of foreleg coasters 20 includes a first bottom face 26, a first top face 28, and a raised first perimeter 30. The first perimeter 30 surrounds the first top face 28. A first cushion layer 32 is continuously disposed upon the first bottom face 26, said first cushion layer 32 in contact with the ground when the present wall guard for furniture kit 10 is installed under a piece of furniture 24 (see FIGS. 1 and 3).

Figure 3:
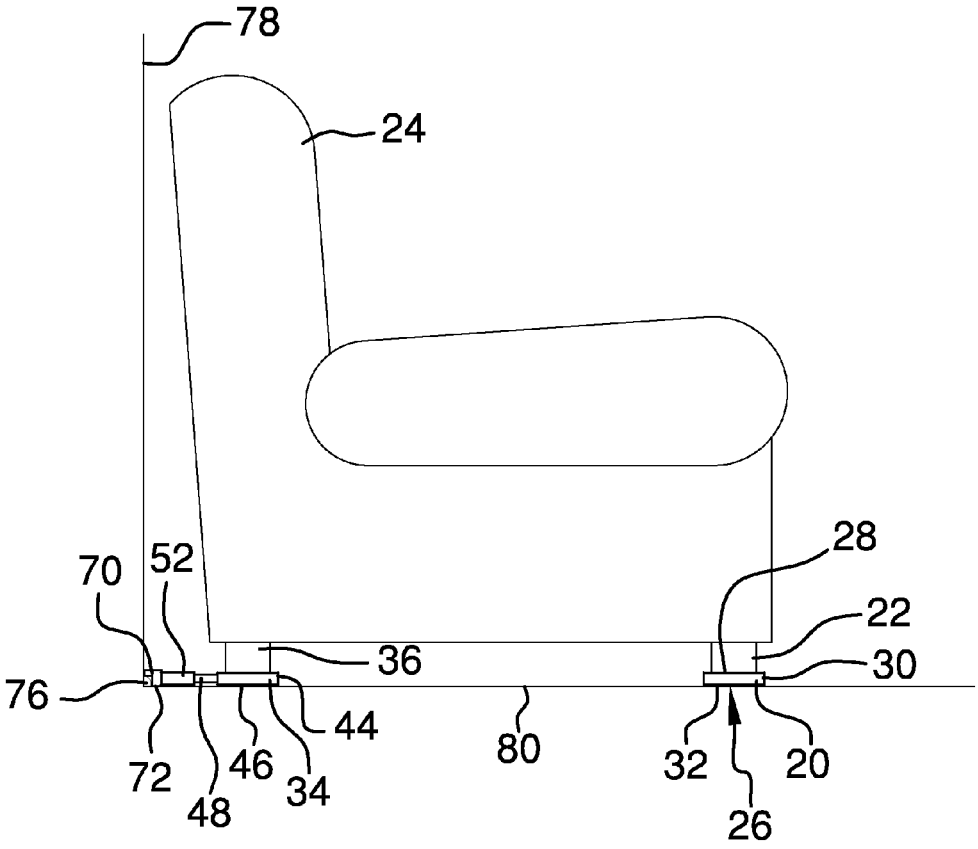
FIG. 3 is an in-use side view.
Figure 4A:
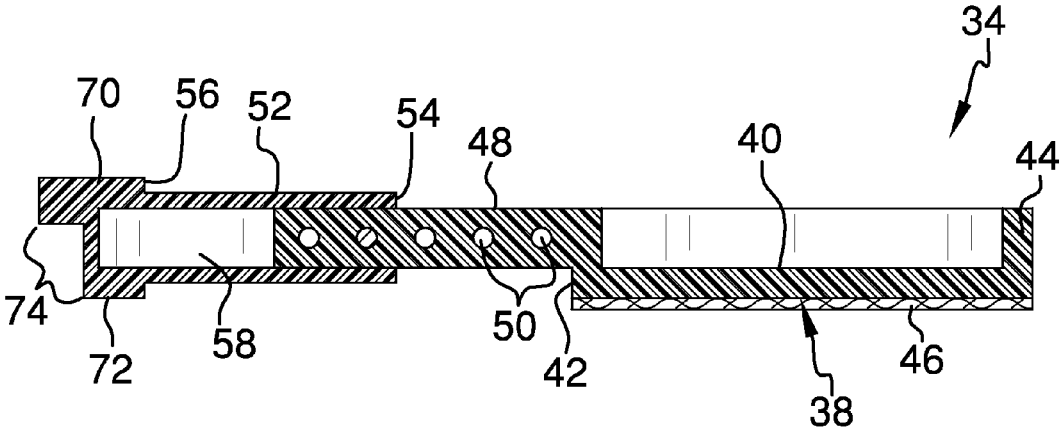
FIG. 4A is a cross section view taken along the line 4A-4A of FIG. 2.
Figure 4B:
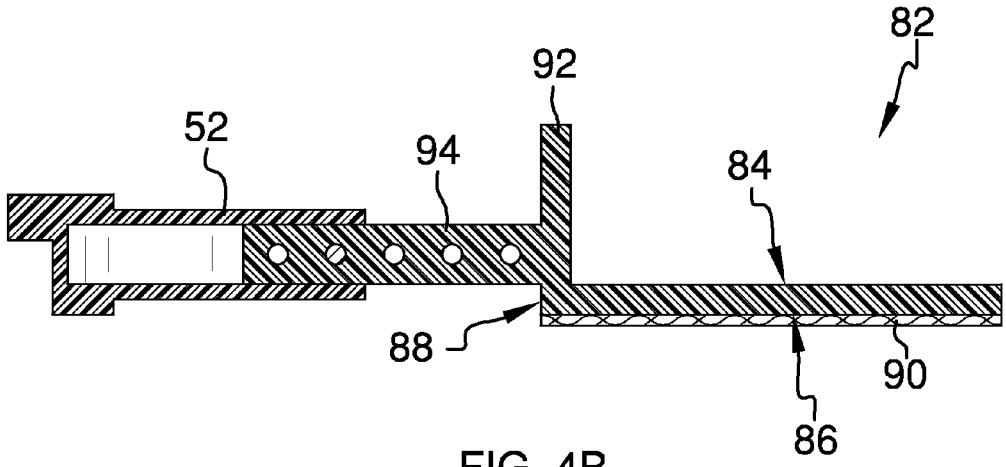
FIG. 4B is a cross section of a flat-top coaster taken along the line 4B-4B of FIG. 5.
Figure 5:
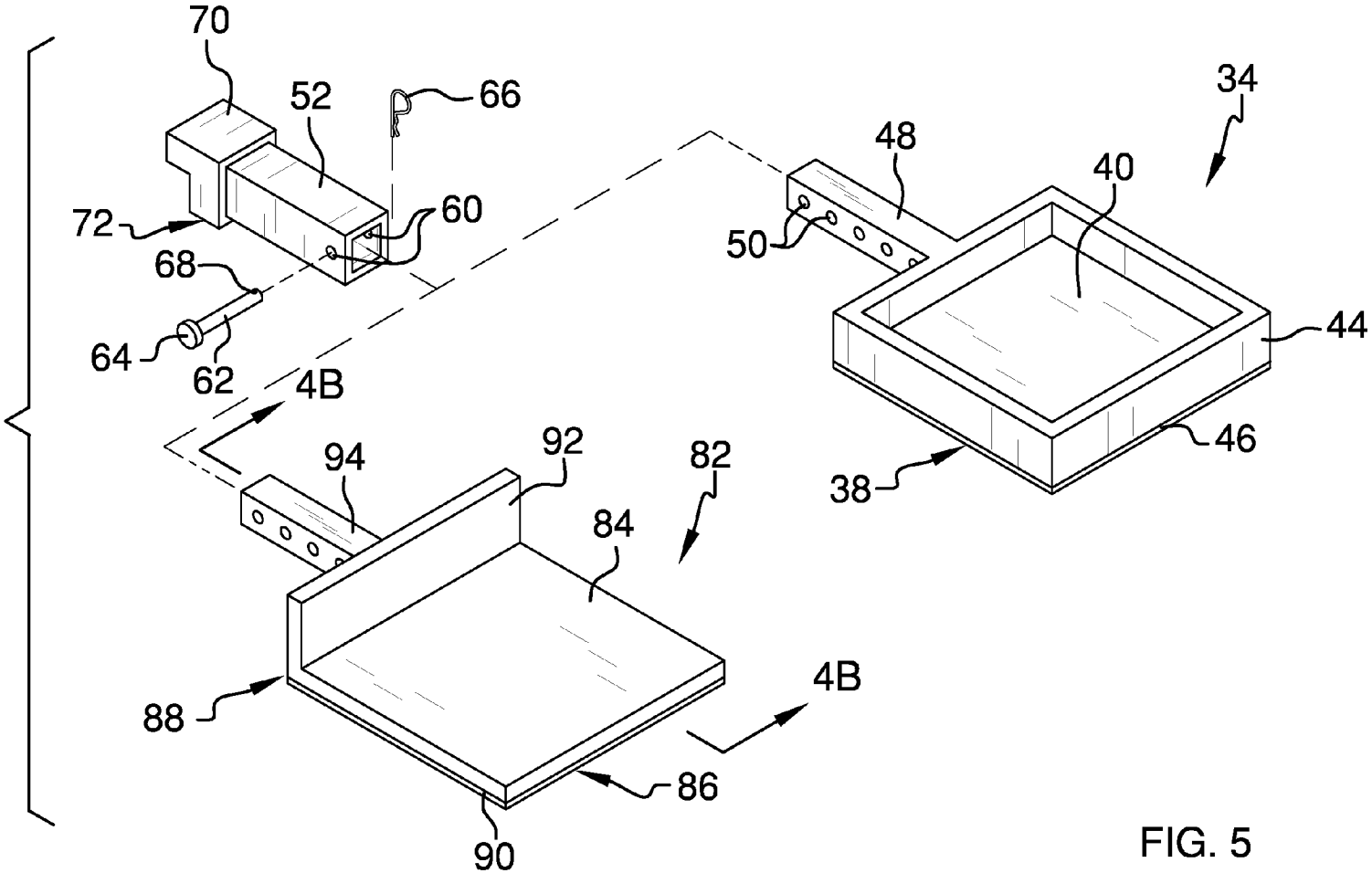
FIG. 5 is an exploded view.

The wall guard for furniture kit 10 also includes each of a pair of rectangular parallelepiped rear leg coasters 34 configured to underlie each of a pair of rear legs 36 of a piece of furniture 24 (see FIGS. 1 and 3). Each of the pair of rear leg coasters 34 has a second bottom face 38, a second top face 40, a rearward edge 42, and a raised second perimeter 44. The second perimeter 44 surrounds the second top face 40 and a second cushion layer 46 is continuously disposed upon the second bottom face 38.

A right prism parallelepiped spur 48 is centrally disposed perpendicular the rearward edge 42, the spur 48 attached to the second perimeter 44. The spur 48 has a plurality of holes 50 disposed equidistantly along opposing sides, said plurality of holes 50 oriented along a plane perpendicular the second top face 40.

A parallelepiped attachment member 52 slidingly receives the spur 48. The attachment member 52 includes a front end 54 and a rear end 56. A central cavity 58 is disposed between the front end 54 and the rear end 56. The cavity 58 is configured to slidingly receive the spur 48.

A pair of holes 60 is disposed proximal the front end 54 on opposing sides of the attachment member 52. The pair of holes 60 is oriented along the same plane as the plurality of holes 50 disposed upon the spur 48. A pin 62 is insertable through the pair of holes 60. The pin 62 is configured to engage with the spur 48 at each of the plurality of holes 50. The pin 62 has a head 64 with a diameter larger than the diameter of each of the pair of holes 60.

A Cotter clip 66 is configured to releasably engage a second pair of holes 68 disposed endwise upon the pin 62 opposite the head 64. The Cotter clip 66 releasably secures the pin 62 in place once inserted through the second pair of holes 68. The spur 48 is therefore fixable at a desired distance within the attachment member 52 by means of the pin 62. The spur 48 is therefore positional within the attachment member 52.

The attachment member 52 has a parallelepiped gnomon 70 disposed on the rear end 56. This gnomon 70 is oriented with a cut-out portion 74 down facing to engage a baseboard 76 at the base of a wall 78 (see FIG. 3). The gnomon 70 has a foot 72 disposed along the same plane as the second bottom face 38. A piece of furniture 24 may thusly be mounted on the wall guard for furniture kit 10 and maintained at a set distance from the baseboard 76 without fear of damaging the baseboard 76, wall 78 or a floor 80 (see FIG. 3).

The wall guard for furniture kit 10 may also include a flat-top coasters 82. The flat-top coaster 82 includes a third top face 84, a third bottom face 86, a rear edge 88, and a third cushion layer 90 continuously disposed upon the third bottom face 86. A rear wall 92 is disposed perpendicularly upon the rear edge 88.

The flat-top coaster 82 has a second spur 94 centrally disposed upon the rear wall 92, the second spur 94 attached proximal the rear edge 88. This second spur 94 is identical with respect to the rear leg coaster 34 spur 48 previously described and slidingly engages with the attachment member 52 (see FIG. 5). Thusly, the flat-top coaster 82 may be used in lieu of the rear leg coaster 34, as desirable when particular furniture requires.

What is claimed is:

1. A wall guard for furniture kit comprising:

a pair of rectangular parallelepiped foreleg coasters, each foreleg coaster comprising:

a first bottom face;

a first top face;

a first cushion layer continuously disposed upon the first bottom face;

a raised first perimeter surrounding the first top face;

the wall guard for furniture kit further comprising:

a pair of rectangular parallelepiped rear leg coasters, each rear leg coaster comprising:

a second bottom face;

a second top face;

a second cushion layer continuously disposed upon the second bottom face;

a raised second perimeter surrounding the second top face;

a rearward edge;

a right prism parallelepiped spur centrally disposed perpendicular the rearward edge, the spur attached to the second perimeter;

a plurality of holes disposed upon the spur, the holes oriented perpendicular the second base;

a parallelepiped attachment member, the attachment member comprising:

a front end;

a rear end;

a central cavity disposed between the front end and the rear end, the cavity configured to slidingly receive the spur;

a pair of holes disposed proximal the front end;

a pin insertable through the pair of holes;

a second pair of holes disposed upon the pin;

a Cotter clip configured to releasably engage the second pair of holes;

a parallelepiped gnomon disposed on the rear end;

wherein the spur is slidingly insertable into the attachment member, the spur securable therein by means of the pin, whereby the attachment member is positional to extend the gnomon to engage a baseboard.

2. The wall guard for furniture kit of claim 1 further comprising a flat-top coaster, the flat-top coaster comprising:

a third top face;

a third bottom face;

a third cushion layer continuously disposed upon the third bottom face;

a rear edge;

a rear wall perpendicularly disposed upon the rear edge;

a second spur centrally disposed upon the rear wall, the second spur proximal the rearward edge;

wherein the second spur is identical to the spur of claim 1.

3. The wall guard for furniture kit of claim 1 wherein the first cushion layer is felt.

4. The wall guard for furniture kit of claim 2 wherein the second cushion layer is felt.

5. The wall guard for furniture kit of claim 4 wherein the third cushion layer is felt.

* * * * *